United States Patent [19]

Day

[11] 4,244,736

[45] Jan. 13, 1981

[54] YTTRIUM CONTAINING ALLOYS

[75] Inventor: Joseph G. Day, Holmer Green, England

[73] Assignee: Johnson, Matthey & Co., Limited, London, England

[21] Appl. No.: 922,158

[22] Filed: Jul. 5, 1978

[30] Foreign Application Priority Data

Jul. 5, 1977 [GB] United Kingdom ..... 28073/77

[51] Int. Cl.[2] ..... C22C 1/00

[52] U.S. Cl. ..... 75/129; 75/57; 75/124; 75/130 R

[58] Field of Search ..... 75/130 R, 129, 57, 124

[56] References Cited

U.S. PATENT DOCUMENTS

| | | | |
|---|---|---|---|
| 2,792,300 | 5/1957 | Livingston | 75/130 R |
| 2,980,529 | 4/1961 | Knapp | 75/57 |
| 3,065,070 | 11/1962 | Otani | 75/130 R |
| 3,980,468 | 9/1976 | Rosof | 75/129 |
| 4,085,252 | 4/1978 | Karinthi | 75/129 |

*Primary Examiner*—P. D. Rosenberg

*Attorney, Agent, or Firm*—Cushman, Darby & Cushman

[57] ABSTRACT

This invention relates to the production of oxidation resistant alloys containing iron, chromium, aluminium and yttrium and/or other rare earth metal or metals in which yttrium and/or other rare earth metal or metals is added to a melt in the form of a master alloy, the master alloy having a melting point of less than 1000° C. The invention also includes an oxidation resistant alloy containing, apart from impurities, yttrium 0.1–3.0%, chromium 5–15%, aluminium 4–6% and iron—balance.

16 Claims, No Drawings

YTTRIUM CONTAINING ALLOYS

This invention relates to the production of oxidation resistant alloys; more particularly it relates to the production of oxidation resistant alloys containing iron, chromium, aluminium and yttrium.

Alloys containing iron, chromium, aluminium and yttrium were originally developed for their oxidation resistance in air at temperatures of over 2000° F. U.S. Pat. No. 3,027,252 (McGurty and Collins) discloses a useful range of compositions for these alloys:

| | |
|---|---|
| chromium | 20.0%-95.0% by weight |
| aluminium | 0.5%-4.0% by weight |
| yttrium | 0.5%-3.0% by weight |
| iron | balance |

While extremely useful, these alloys are adversely affected by holding at temperatures encountered in the presence of super-heated steam in nuclear reactor technology. The alloys become severely hardened and embrittled within several hours at temperatures of from 650°-1,000° F.

An improvement to the range of alloys was therefore made by Wukusick as described in the U.S. Pat. No. 3,298,826. Wukusick found that the embrittlement of iron, chromium, aluminium and yttrium alloys was avoided by reducing the chromium content to a level below the previously described minimum.

Wukusick's alloys have composition ranges as follows:

| | |
|---|---|
| chromium | 0-20.0% by weight |
| aluminium | 0.5-12.0% by weight |
| yttrium | 0.1-3.0% by weight |
| iron | balance |

These alloys are less susceptible to embrittlement but exhibit substantially the same superior resistance to oxidation and corrosion.

The present method of adding yttrium to the melt containing iron, chromium and aluminium (melting point 1400° C.) is via the pure metal (which melts at 1525± or −5° C.). Yttrium losses can occur as follows:

(a) reaction with the oxygen and nitrogen in the furnace atmosphere while the metal is dissolving in the melt (b) de-oxidation of the melt (c) reaction with the refractory liners Losses of yttrium by the above reactions are likely to be variable leading to inconsistent products. Recovery of finished strip from the cast ingot is usually less than 40% and can be zero.

It is an object of the present invention to provide an improved method for the manufacture of the above-described yttrium-containing alloys.

In our co-pending application Ser. No. 28072/77 relating to the production of pure yttrium metal and alloys thereof it is disclosed that yttrium fluroide ($YF_3$) can be reduced in a molten slag/submerged electric arc process by the use of calcium metal and in the presence of iron to produce an alloy containing 75% by weight yttrium.

The above-mentioned co-pending application also discloses the use of the same technique for the production of Al-Y containing alloys and also Fe-Al-Y containing alloy. A useful Al-Y containing alloy is one containing 90% by weight Y and 10% by weight Al. The Fe-Y containing alloy melts at 900° C. and the Al-Y containing alloy eutectic melts at 960° C.

According to the present invention a process for the production of oxidation-resistant alloys containing iron, chromium, aluminium and yttrium includes the step of the addition of yttrium to a melt in the form of a master alloy containing the yttrium, the master alloy having a melting point less than 1000° C.

It is preferred to add the master alloy to the melt in an atmosphere from which oxygen is excluded. Argon or other inert atmospheres are suitable.

Preferred master alloys are alloys of yttrium and iron, alloys of yttrium and aluminium and alloys of yttrium, iron and aluminium. Preferred approximate compositions of the master alloy are as follows:

If desired the addition may be carried out under vacuum.

| | | |
|---|---|---|
| Y—Fe: | Y | 75% by weight |
| | Fe | 25% by weight |
| Y—Al: | Y | 90% by weight |
| | Al | 10% by weight |
| Y—Al—Fe: | Y | 80% by weight |
| | Al | 10% by weight |
| | Fe | 10% by weight |

The alloy may contain from 0.1% to 3.0% by weight of yttrium, but preferably the quantity of master alloy added to the melt should be such that the quantity of yttrium present in the final alloy is in the region of 0.3% by weight. Quantities of other metals present in the melt should preferably be apportioned to provide a final alloy range:

| | % by weight |
|---|---|
| Cr | 5-15 |
| Al | 4-6 |
| Fe | balance |

Operation of the invention provides good quality homogeneous yttrium-containing alloy exhibiting the required oxidation and corrosion resistance. The so-produced alloys may be satisfactorily rolled into sheet, cut into strip and rolled-up. Such strip is suitable for use as a catalyst substrate described in U.S. Pat. No. 3,920,583.

In a further development of the present invention the yttrium may be partially or fully replaced by a concentrate of rare-earth metals. The partial or full replacement of yttrium by these metals still enables the production of alloys having the same degree of mechanical strength and oxidation and corrosion resistance to be carried out. The total rare-earth metal concentration in the final alloy should preferably remain the same as the yttrium which they replace, i.e. 0.1-3.0% by weight, preferably 0.3% by weight.

Such concentrates are available from Rare Earth Products Ltd., Widnes, U.K. and contain the metals as isolated from their naturally occurring minerals but not necessarily from each other.

Examples of minerals which are suitable sources of rare earth metals are:

| | |
|---|---|
| Cerite | $H_3(Ca,Fe)Ce_3Si_3O_{13}$ |
| Orthite (Allarite) | $Al(OH)Ca_2(Al,Fe,Ce)_2(SiO_4)_3$ |

-continued

| | |
|---|---|
| Gadolinite | $FeBe_2Y_2Si_2O_{10}$ |
| Xenotime | $YPO_4$ |
| Fergusonite | $YNbO_4$ |
| Australian fergusonite | $YTaO_4$ |
| Yttrotantalite | $Y_4(Ta_2O_7)_3$ |
| Monazite | Cerium and lanthanum phosphate |

Cerite contains La, Pr, Nd, Sa, Ce and traces of others. Gadolinite contains chiefly Y, Er with only small amounts of Ce and La.

According to a second aspect of the present invention an oxidation-resistant alloy contains apart from impurities:

| | % by weight |
|---|---|
| Cr | 1–20 |
| Al | 0.5–12 |
| One or more rare earth metals | 0.1–3 |
| Fe | balance |

According to a third aspect of the present invention a process for the production of oxidation resistant alloys containing iron, chromium, aluminium and one or more rare earth metals includes the step of the addition of the rare earth metals to a melt in the form of a master alloy containing the rare earth metals in which the said master alloy has a melting point less than 1000° C.

It is preferred to add the master alloy to the melt in an atmosphere from which oxygen is excluded. Argon or nitrogen atmospheres are suitable.

Preferred master alloys are alloys of rare-earth metals and iron and rare earth metals and aluminium.

What I claim is:

1. A process for the production of alloys containing iron, chromium, aluminium and yttrium and/or other rare earth metal or metals in which yttrium and/or other rare earth metal or metals is added to a melt in the form of a master alloy, the master alloy having a melting point of less than 1000° C.

2. A process as claimed in claim 1 in which the master alloy is an alloy of yttrium and iron aluminium.

3. A process as claimed in claim 2 in which the master alloy consists of 75% by weight of the rare earth metal and 25% by weight of iron.

4. A process as claimed in claim 2 in which the master alloy consists of 90% by weight of the rare earth metal and 10% by weight of aluminium.

5. A process as claimed in claim 2 in which the master alloy consists of 80% by weight of yttrium, 10% by weight of aluminium and 10% by weight of iron.

6. A process as claimed in claim 1 in which the resulting alloy contains from 0.1% to 3.0% by weight of the rare earth metal.

7. A process as claimed in claim 6 in which the resulting alloy contains about 0.3% by weight of the rare earth metal.

8. A process as claimed in any one of the preceding claims in which the addition is made to the melt in an atmosphere free from oxygen.

9. An alloy produced by a process as claimed in any one of claims 1 to 7.

10. An oxidation-resistant alloy containing by weight:

| | |
|---|---|
| yttrium | 0.1–3.0% |
| chromium | 5–15% |
| aluminium | 4–6% |
| iron | balance |

11. An oxidation-resistant alloy containing apart from impurities, 1–20% by weight chromium, 0.5–12% by weight aluminium, 0.1–3% by weight of at least one rare earth metal, balance iron.

12. An alloy as claimed in claim 10 or 11 containing lanthanum, praseodymium, neodymium, samarium and cerium.

13. An alloy as claimed in claim 10 or 11 containing yttrium and erbium with cerium and lanthanum.

14. An alloy as claimed in claim 10 or 11 wherein the rare earth metal is obtained from at least one of the following minerals: Cerite, Orthite (Allanite), Gadolinite, Xenotime, Fergusonite, Australian fergusonite, Yttrotantalite, Monazite.

15. A process as in any one of claims 1, 3, 4, 6 or 7 wherein the rare earth metal includes yttrium.

16. An alloy as in claim 11 wherein the rare earth metal includes yttrium.

* * * * *